US007963465B2

(12) United States Patent
Lander et al.

(10) Patent No.: US 7,963,465 B2
(45) Date of Patent: Jun. 21, 2011

(54) INJECTION VALVE

(75) Inventors: Jürgen Lander, Stuttgart (DE); Dieter Maier, Rettenberg (DE); Franz Thoemmes, Bietigheim-Bissingen (DE)

(73) Assignee: Robert Bosch GmbH, Stuttgart (DE)

( * ) Notice: Subject to any disclaimer, the term of this patent is extended or adjusted under 35 U.S.C. 154(b) by 433 days.

(21) Appl. No.: 11/792,165

(22) PCT Filed: Oct. 5, 2005

(86) PCT No.: PCT/EP2005/055005

§ 371 (c)(1),
(2), (4) Date: Mar. 19, 2008

(87) PCT Pub. No.: WO2006/061268

PCT Pub. Date: Jun. 15, 2006

(65) Prior Publication Data

US 2008/0265065 A1 Oct. 30, 2008

(30) Foreign Application Priority Data

Dec. 7, 2004 (DE) ..... 10 2004 058 803

(51) Int. Cl.
*B05B 1/30* (2006.01)

(52) U.S. Cl. ..... 239/585.5; 239/585.1; 239/585.4

(58) Field of Classification Search ..... 239/585.1, 239/585.4, 585.5

See application file for complete search history.

(56) References Cited

U.S. PATENT DOCUMENTS

| | | | | |
|---|---|---|---|---|
| 4,331,317 | A | 5/1982 | Kamai et al. | |
| 5,566,920 | A | 10/1996 | Romann et al. | |
| 5,775,600 | A | 7/1998 | Wildeson et al. | |
| 6,273,346 | B1 * | 8/2001 | Estevenon et al. | 239/533.9 |
| 6,409,102 | B1 * | 6/2002 | Luttrell et al. | 239/585.4 |
| 6,908,050 | B2 * | 6/2005 | Sekine et al. | 239/585.1 |
| 7,063,279 | B2 * | 6/2006 | Mizuno et al. | 239/585.1 |
| 2002/0084365 | A1 | 7/2002 | Dallmeyer et al. | |
| 2009/0179090 | A1 * | 7/2009 | Reiter | 239/585.1 |

FOREIGN PATENT DOCUMENTS

| | | |
|---|---|---|
| DE | 42 30 376 | 4/1993 |
| DE | 44 15 850 | 11/1995 |
| EP | 0 582 296 | 2/1994 |
| EP | 0 806 565 | 11/1997 |
| JP | 9-503267 | 3/1997 |
| JP | 2003-314401 | 11/2003 |
| JP | 2004-308703 | 11/2004 |
| WO | WO 2004/088118 | 10/2004 |

* cited by examiner

*Primary Examiner* — Christopher S Kim
(74) *Attorney, Agent, or Firm* — Kenyon & Kenyon LLP

(57) ABSTRACT

An injection valve for fuel-injection systems has a valve-seat support, a valve needle, a solenoid and a connection piece having a filter, to convey the fuel. Valve opening and valve seat are formed on the one-piece valve-seat support itself, which additionally guides the valve needle so as to be axially displaceable; solenoid coil and connector plug are combined in a separate, plastic-extrusion-coated coil part, the magnetic cup is placed over the coil part, and the connection piece is formed as separate plastic-injection-molded part having an integrated filter. Joining and sealing points between the connection piece on the one side and the coil part, magnetic cup and/or valve-seat support on the other side are bonded.

17 Claims, 1 Drawing Sheet

INJECTION VALVE

BACKGROUND OF THE INVENTION

1. Field of the Invention

The present invention relates to an injection valve, in particular for fuel injection systems of internal combustion engines of motor vehicles.

2. Description of Related Art

A known injection valve for fuel-injection systems for internal combustion engines described in published German patent document DE 42 30 376 has a valve-seat support in which a valve-seat body is inserted at the extremity. The valve opening and the valve seat surrounding the valve opening are formed on the valve-seat body. The hollow-cylindrical valve needle is open at one needle end for the entry of fuel, and other needle end is sealed by a spherical valve-closure member, which is welded onto the valve needle and provided with radial exit holes for the fuel. The valve-seat support is affixed on the hollow-cylindrical solenoid core via an intermediate piece, by welding, for instance. Opposite the hollow-cylindrical magnetic core, forming a working air gap, is the magnetic armature, which is integrally formed with and situated on the valve needle. The valve needle is guided in the intermediate piece via its magnetic armature in an axially displaceable manner. The solenoid coil, made up of a coil body and an excitation winding wound inside the coil body, is slipped over the solenoid core. The excitation winding is connected to a connector plug. The end of the solenoid core facing away from the magnetic armature is formed as connection piece for the fuel-supply line, in which a fuel filter is inserted. The solenoid coil is surrounded by a ferromagnetic conductive element having the form of a bracket, which rests against the solenoid core via its one end and against the valve-seat support via its other end and is joined thereto by welding or soldering, for example. Solenoid core, solenoid coil having ferromagnetic conductive element, and valve-seat support are enclosed by a plastic-extrusion coat in which the connector plug is integrated. The valve needle is produced with the aid of so-called MIM technology (metal injection molding), by injection molding and subsequent sintering. The valve needle is injection-molded from a metal powder having an adhesive agent, such as a plastic adhesive agent. The adhesive agent is removed again by sintering. The sleeve-shaped or cylindrical valve needle produced in this manner, in which the exit holes are already formed and the solenoid core is premolded, is joined to the spherical valve-closure member via its end face, by welding.

A BRIEF SUMMARY OF THE INVENTION

The injection valve according to the present invention has the advantage that the functions of the injection valve are combined in complex components, which are able to be produced in a cost-efficient manner by injection-molding technology such as MIM (metal injection molding), CIM (ceramic injection molding) or plastic-injection molding on the one hand, and which allow streamlining of the assembly line with a gain in assembly speed on the other hand. The complicated and expensive extrusion-coating of the injection valve with plastic on the assembly line is avoided. Since the components are bonded at the joining and sealing points instead of welded, warping of the components is avoided, and metal and plastic components are able to joined without any problems and in a reliable manner.

Moreover, due to the modular construction according to the present invention, technical characteristics of the injection valve that are essential also to the customer are able to be improved as well. For instance, the valve noise is reduced since the valve-seat support is a solid component and valve seat and valve-needle guide are combined therein. Since the support function for solenoid coil and connection piece is no longer required, the magnetic circuit is able to be optimized with regard to its iron volume, in such a way that induced turbulence is reduced and switching times are shortened, which improves the dynamic flow range (DFR).

According to an advantageous example embodiment of the present invention, the hollow-cylindrical solenoid core is pressed into the valve-seat support. Due to the wall thickness of the valve-seat support, a pure press fit suffices for the stability of the connection, so that the solenoid core need not be additionally affixed on the valve-seat support. The axial insertion depth of the solenoid core defines the maximum lift of the valve needle.

DETAILED DESCRIPTION OF THE INVENTION

Figure 1:
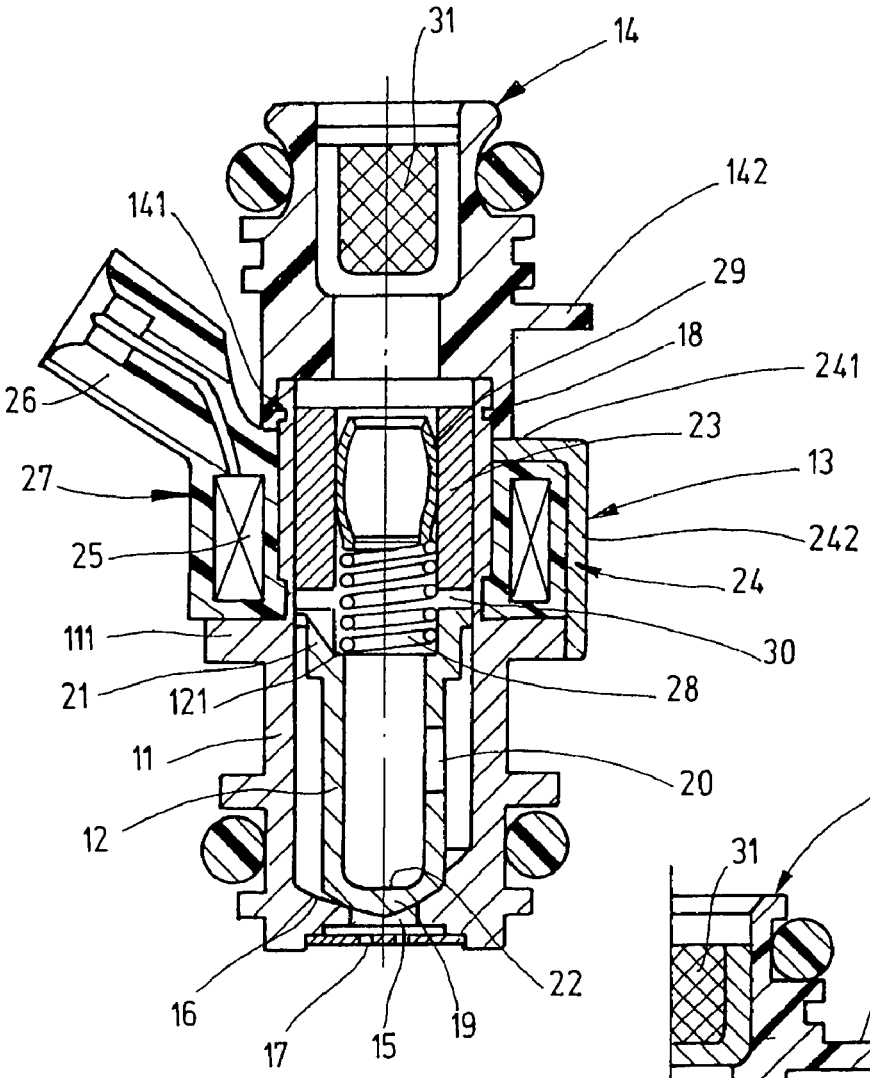
FIG. 1 shows a longitudinal cross-section of an injection valve.

The injection valve schematically shown in FIG. 1 in longitudinal section is used in fuel-injection systems of internal combustion engines in motor vehicles. It has a valve-seat support 11, a valve needle 12 disposed coaxially inside valve-seat support 11, a solenoid 13 for actuating valve needle 12, and a connection piece 14 for conveying fuel. Valve-seat support 11 is made as so-called MIM component, of a hard magnetic material such as KM57 or a partially hardenable magnetic material, by injection molding and subsequent sintering according to the metal-injection molding method. During production of valve-seat support 11, a valve opening 15 and a valve seat 16 surrounding it are formed or premolded in its base region. Valve seat 16 is ground or honed in its final state. In the base of valve-seat support 11, on the outer side facing away from valve seat 16, a recess 17 is formed coaxially with respect to valve opening 15, in which a spray-orifice plate 17 is fixed in place by bonding. At its end facing away from valve seat 16, valve-seat support 11 is provided with a circumferential annular groove 18 on the outside. If valve-seat support 11 is not made of hard, but partially hardenable magnetic material, it will be hardened in the region of valve seat 16.

Valve needle 12, which has a hollow-cylindrical design in the exemplary embodiment of FIG. 1, is open at its end facing away from valve seat 16, for the entry of fuel, and carries at its other end facing valve seat 16 a valve-closure member 19, which cooperates with valve seat 16 to release and close valve opening 15. Valve needle 12 is provided with at least one exit hole 20 for the discharge of fuel, which extends radially through the cylinder wall. Situated at the end of valve needle 12, facing away from valve-closure member 19, is a magnetic armature 21 via which valve 12 is guided in valve-seat support 11 so as to be axially displaceable. Valve needle 12 is produced together with valve-closure member 19 and magnetic armature 21 as a one-piece MIM component, from a hard, magnetically soft material. With the aid of MIM technology, it is possible to produce exit holes 20 as well as planar surface 22 aligned inside on valve-closure member 19. This planar surface 22 is used as reflection surface for a laser beam during the dry adjustment of the valve lift. The outer contour of valve-closure member 19 cooperating with valve seat 16 is partially ground, and various contours such as a spherical form or an edge seat with damping cone may be realized.

In addition to magnetic armature 21 integrally formed as one piece with valve needle 12, solenoid 13 includes a hollow-cylindrical solenoid core 23 lying on the inside, a deep-drawn magnetic cup 24 lying on the outside, and a solenoid coil 25 which is situated between solenoid core 23 and magnetic cup 24 and made up of an excitation winding wound onto a coil brace in the conventional manner. Solenoid coil 25 is connected to a connector plug 26. Hollow-cylindrical solenoid core 23 is pressed into valve-seat support 11 on the end of valve-seat support 11 facing away from valve seat 16. Its insertion depth defines the lift of valve needle 12. Due to the relatively high wall thickness of valve-seat support 11, a pure press-fit achieves sufficient stability of the connection of solenoid core 23 and valve-seat support 11. Solenoid coil 25 and connector plug 26 are combined into a plastic-extrusion-coated coil part 27, which is produced and supplied as a separate component outside the assembly line and slipped onto valve-seat support 11. Magnetic cup 24 is placed on top of plastic-extrusion-coated coil part 27, cup base 241 of magnetic cup 24 surrounding valve-seat support 11 and its cup casing 242 overlapping a radial flange 111 premolded on valve-seat support 11 at the cup-opening edge, virtually without play. Radial flange 11 is situated on valve needle 12 at the level of solenoid core 23. Via its valve-closure member 19, valve needle 12 is pressed onto valve seat 16 by a valve-closure spring 28 configured as compression spring. To this end, valve-closure spring 28 is braced inside a radial annular shoulder 121 formed in the interior of valve 12 on the one hand, and on an adjusting sleeve 29, which is pressed into solenoid core 23, on the other hand. The press-in depth of adjusting sleeve 29 defines the resilience of valve-closure spring 28 and thus the closing force of valve needle 12. When the valve is closed, a working air gap 30 is present between the annular end faces of magnetic armature 21 and solenoid core 23.

Connection piece 14 is produced as separate injection-molded plastic component having an integrated filter 31. For one, it has an annular bar 141, which is able to produce a clip connection with annular groove 18 on valve-seat support 11, and a radially projecting installation lip 142, which is provided as anti-rotation element and used to install the injection valve in a fuel-collection line in its correct position. Depending on the serial type of the injection valve, installation lip 142 on connection piece 14 may be offset in an axial and radial direction. At the end of the assembly line connection piece 14 is clipped onto valve-seat support 11 pointing in the direction of spray-orifice plate 17 and bonded to valve-seat support 11 and/or magnetic cup 24.

The volume of the magnetic circuit formed by solenoid core 23, magnetic cup 24, radial flange 11 and magnetic armature 21 is minimized, which is why the wall thicknesses of the mentioned components have the thinnest possible design on the one hand, and the magnetic circuit has a rectangular design on the other hand.

Figure 2:
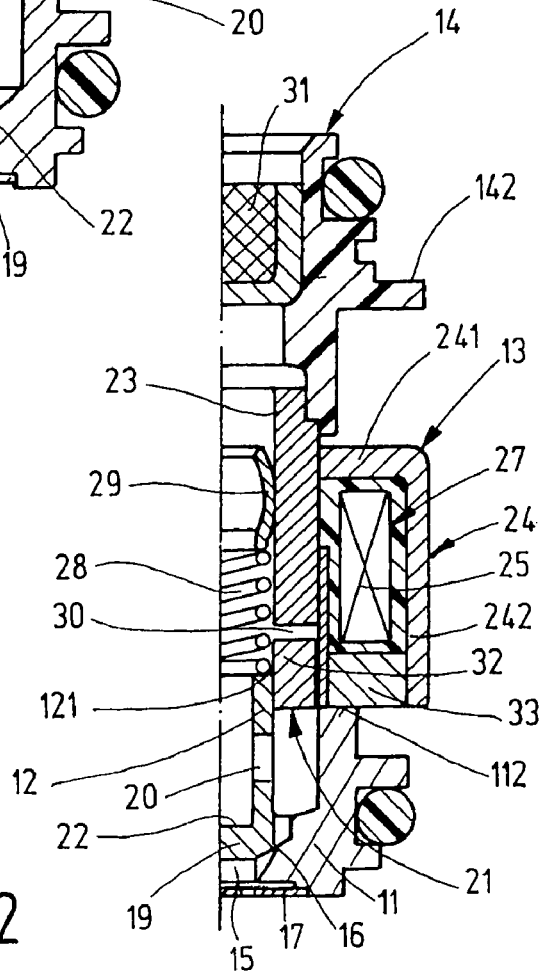
FIG. 2 shows a longitudinal cross-section of one-half of an injection valve according to an additional exemplary embodiment.

The injection valve schematically shown in semi-section in FIG. 2 has been modified in its valve-seat support 11 and valve needle 12 compared to the previously described injection valve. Valve-seat support 11 and valve needle 12 are not made of magnetically soft material, but from a hard material and produced using MIM technology. However, valve needle 12 may also be produced according to a so-called CIM method (ceramic injection molding). Magnetic armature 21 is not premolded on valve needle 12 as one piece here, but affixed on valve needle 12 as a separate, magnetically soft ring 32 by pressing, welding or form-fitting. Valve-seat support 11 has thin walls in its region surrounded by solenoid 13, so that an annular shoulder 112 results due to the step in the wall thickness, which extends on the outside circumference of valve-seat support 11. Solenoid core 23 is pressed into the thin-walled region of valve-seat support 11 and welded thereto. Plastic-extrusion-coated coil part 27 is slipped over solenoid core 23 and the thin-walled region of valve-seat support 11 and preferably bonded to both. Deep-drawn magnetic cup 24 is placed on top of solenoid core 23 by its cup base 241 and joined thereto, preferably by welding. The annular cup opening is covered by a ring 33 made of magnetically soft material, which rests against annular shoulder 112 of valve-seat support 11 and is joined to valve-seat support 11 via its inner edge, and to cup casing 242 of magnetic cup 24 via its outer edge in a keyed connection, for instance by pressing or welding.

In an alternative example embodiment, which is not shown here, the valve needle may also be embodied as solid tappet to whose one end the spherical valve-closure member is welded and at whose other end the magnetic armature is situated, e.g., integrally formed, the armature simultaneously providing the axial guidance of the valve needle in valve-seat support 11. Such a valve needle may be seen in published German patent document DE 44 15 850.

What is claimed is:

1. An injection valve for a fuel-injection system of an internal combustion engine, comprising:

a one-piece valve-seat support;

a valve seat situated at an end of the one-piece valve-seat support and having a valve opening, wherein the valve opening and the valve seat are integrally formed on the one-piece valve-seat support;

a valve needle coaxially disposed in the valve-seat support so as to be axially displaceable, wherein the valve needle has a valve-closure member at a first end facing the valve seat, and wherein the valve closure member cooperates with the valve seat in order to close and release the valve opening;

a solenoid for providing a lift actuation of the valve needle, wherein the solenoid includes an inner, hollow-cylindrical magnetic core, an outer magnetic cup, and a solenoid coil which is situated between the magnetic core and the magnetic cup, and wherein the solenoid coil is connected to a connector plug;

a magnetic armature situated axially opposite the solenoid core and disposed at a second end of the valve needle facing away from the valve-closure member; and a connection piece for supplying fuel, wherein the connection piece includes a filter;

wherein axial guidance of the valve needle is provided by the valve-seat support, and wherein the solenoid coil and the connector plug are combined into a separate plastic-extrusion-coated coil part which is placed on top of the valve-seat support, and wherein the magnetic cup is placed on top of the plastic-extrusion-coated coil part in such a way that a magnetic circuit including the solenoid core, the magnetic cup, the valve-seat support and the magnetic armature is closed, and wherein the connection piece is formed as a second separate plastic extrusion-coated component in which the filter is integrated, and wherein joining and sealing points are bonded between the connection piece on one side and at least one of the coil part, the magnetic cup and the valve-seat support on the other side.

2. The injection valve as recited in claim 1, wherein the hollow-cylindrical solenoid core is pressed into the valve-seat support.

3. The injection valve as recited in claim 1, wherein the valve-seat support with the valve opening and the valve seat is produced as a metal-injection-molding component, and wherein the valve seat is one of ground and honed.

4. The injection valve as recited in claim 1, wherein the valve needle and the valve-closure member are produced together as one of a one-piece metal-injection-molding component and a one-piece ceramic-injection-molding component, and wherein an outer contour of the valve-closure member cooperating with the valve seat is at least partially ground.

5. The injection valve as recited in claim 4, wherein the valve needle is hollow-cylindrical and has an open end for fuel entry and at least one radial exit hole for fuel discharge.

6. The injection valve as recited in claim 1, wherein a radially-projecting installation lip is injection-molded on the connection piece for correct positioning of the injection valve in a fuel-collection rail, and wherein the radially-projecting installation lip is configured as an anti-rotation element.

7. The injection valve as recited in claim 1, further comprising:

a spray-orifice plate which covers the valve opening downstream in a fuel flow, wherein the spray-orifice plate is cemented in place in the valve-seat support.

8. The injection valve as recited in claim 1, wherein the volume of the magnetic circuit including the solenoid core, the magnetic cup, the valve-seat support and the magnetic armature is minimized, and wherein the magnetic circuit has a rectangular configuration.

9. The injection valve as recited in claim 4, wherein the valve-seat support is made of magnetically soft material which is hard in the area of the valve seat, and wherein the valve needle is made of one of magnetically soft material and a magnetically hard material, and wherein the magnetic armature is integrally molded on the valve needle.

10. The injection valve as recited in claim 9, wherein the magnetic cup is slipped over the valve-seat support via a base of the magnetic cup, and wherein a cup casing of the magnetic cup overlaps a radial flange of the injection valve at a cup opening, and wherein the radial flange is integrally molded on the valve-seat support at approximately the region of the magnetic armature.

11. The injection valve as recited in claim 9; wherein on an end section of the valve-seat support facing away from the valve seat has an annular groove, and wherein the connection piece has an annular bar, and wherein the connection piece is clipped into the annular groove so as to produce a clip connection.

12. The injection valve as recited in claim 4, wherein the valve-seat support and the valve needle are made of hard metal, and wherein the magnetic armature is configured as ring made of magnetically soft material and affixed on the valve needle by one of pressing, welding and form-locking.

13. The injection valve as recited in claim 12, wherein the magnetic cup is slipped over the solenoid core via a base of the magnetic cup, and wherein an annular cup opening of the magnetic cup is covered by a ring made of magnetically soft material, and wherein the ring is connected on the outside to a cup casing of the magnetic cup by form-locking, and wherein the ring is connected on the inside to the valve-seat support at approximately the region of the magnetic armature.

14. The injection valve as recited in claim 13, wherein the valve-seat support has a thin wall in a region enclosed by the solenoid, and wherein the magnetic armature configured as a ring made of magnetically soft material axially abuts an annular shoulder defined by a step in the wall thickness of the valve-seat support, and wherein the solenoid core is pressed into the thin-walled region of the valve-seat support and welded to the valve-seat support.

15. The injection valve as recited in claim 12, wherein the connection piece is placed over the solenoid core so as overlap the solenoid core along an edge, and wherein the connection piece is bonded to at least one of the solenoid core and the magnetic cup.

16. The injection valve as recited in claim 13, wherein the connection piece is placed over the solenoid core so as to overlap the solenoid core along an edge, and wherein the connection piece is bonded to at least one of the solenoid core and the magnetic cup.

17. The injection valve as recited in claim 14, wherein the connection piece is placed over the solenoid core so as to overlap the solenoid core along an edge, and wherein the connection piece is bonded to at least one of the solenoid core and the magnetic cup.

* * * * *